US009038844B2

(12) United States Patent
Varbanov

(10) Patent No.: US 9,038,844 B2
(45) Date of Patent: May 26, 2015

(54) CONTAINER AND POUCH

(75) Inventor: Petar Varbanov, Bulle (CH)

(73) Assignee: Nestec S.A., Vevey (CH)

( * ) Notice: Subject to any disclaimer, the term of this patent is extended or adjusted under 35 U.S.C. 154(b) by 121 days.

(21) Appl. No.: 13/995,425

(22) PCT Filed: Dec. 21, 2011

(86) PCT No.: PCT/EP2011/073638

§ 371 (c)(1),
(2), (4) Date: Jun. 18, 2013

(87) PCT Pub. No.: WO2012/085117

PCT Pub. Date: Jun. 28, 2012

(65) Prior Publication Data

US 2013/0277265 A1 Oct. 24, 2013

(30) Foreign Application Priority Data

Dec. 21, 2010 (EP) ..... 10196359

(51) Int. Cl.

| | |
|---|---|
| ***B65D 25/16*** | (2006.01) |
| ***B65D 77/04*** | (2006.01) |
| ***B65D 30/20*** | (2006.01) |
| ***B65D 77/06*** | (2006.01) |
| *B65D 90/04* | (2006.01) |

(52) U.S. Cl.

CPC ..... *B65D 77/04* (2013.01); *B65D 31/10* (2013.01); *B65D 77/06* (2013.01)

(58) Field of Classification Search

USPC ..... 220/495.03, 495.08, 495.11, 254.3

See application file for complete search history.

(56) References Cited

U.S. PATENT DOCUMENTS

| | | | | |
|---|---|---|---|---|
| 4,267,928 | A | 5/1981 | Curry | |
| 5,165,568 | A * | 11/1992 | Wischusen, III | 229/164.1 |
| 5,690,248 | A * | 11/1997 | Hulls | 220/495.05 |
| 5,944,251 | A * | 8/1999 | LaFleur | 229/117.35 |
| 6,651,873 | B2 * | 11/2003 | Quaintance | 229/109 |
| 6,740,346 | B2 * | 5/2004 | Shapiro | 426/124 |
| 7,150,380 | B2 * | 12/2006 | Hoepner et al. | 222/480 |
| 8,220,651 | B2 * | 7/2012 | Norcom | 220/1.6 |
| 2003/0066835 | A1 * | 4/2003 | Sadr et al. | 220/495.11 |
| 2006/0165319 | A1 * | 7/2006 | Patridge et al. | 383/107 |
| 2008/0179357 | A1 * | 7/2008 | Priolo et al. | 224/148.6 |

(Continued)

FOREIGN PATENT DOCUMENTS

| | | |
|---|---|---|
| GB | 2450996 | 1/2009 |
| WO | WO2008147082 | 12/2008 |

OTHER PUBLICATIONS

Search Report for International Patent Application No. PCT/EP2011/073638 mailed Apr. 17, 2012.

(Continued)

*Primary Examiner* — Mickey Yu
*Assistant Examiner* — Niki Eloshway
(74) *Attorney, Agent, or Firm* — K&L Gates LLP

(57) ABSTRACT

The present invention relates to a container (2) and a pouch (1). The container and pouch is preferably mutually shaped so that the pouch fits tightly into the container. The container comprises a closure (5) for closing the container and preferably being adapted to maintain the pouch in an open state in a position where its opening is facing upwardly. In addition, the closure comprises a lid (7), allowing re-closable access to the contents stored in the pouch.

9 Claims, 7 Drawing Sheets

(56) References Cited

U.S. PATENT DOCUMENTS

2009/0101653 A1* 4/2009 Perez ..... 220/495.08
2009/0314786 A1* 12/2009 Cardinale ..... 220/592.2

OTHER PUBLICATIONS

Written Opinion for International Patent Application No. PCT/EP2011/073638 mailed Apr. 17, 2012.

* cited by examiner

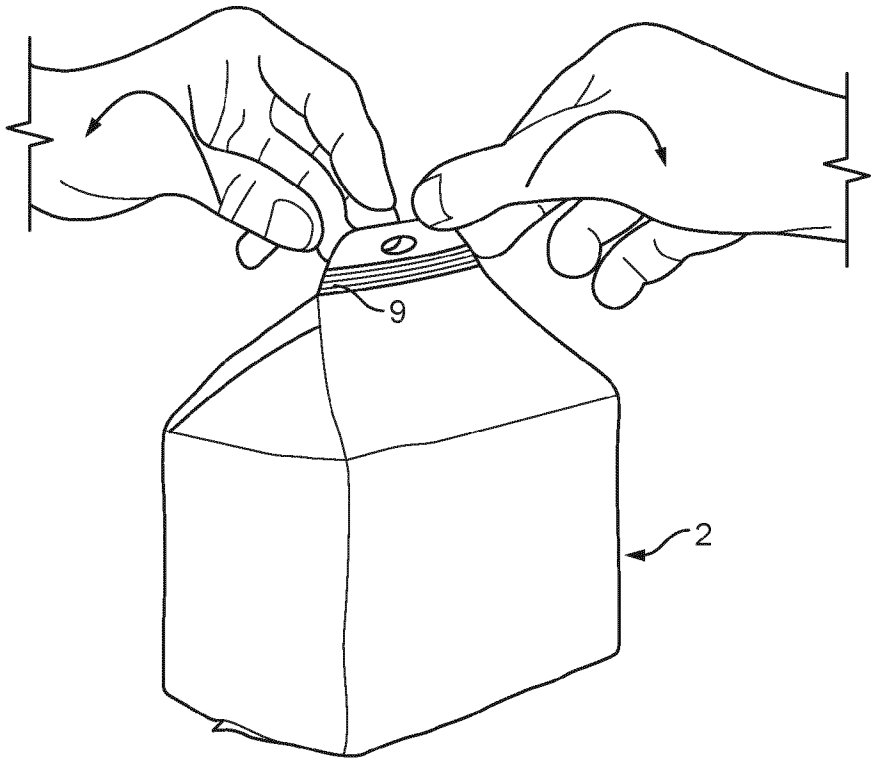
FIG. 2
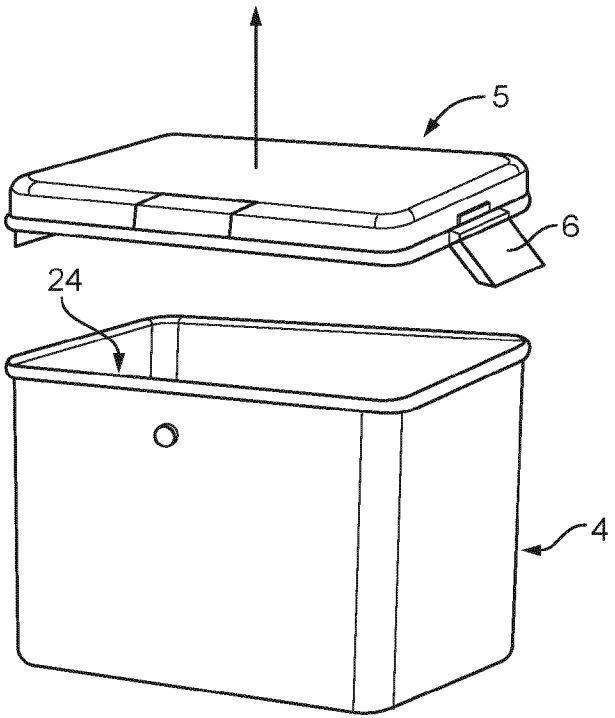

CONTAINER AND POUCH

CROSS REFERENCE TO RELATED APPLICATIONS

The present application is a National Stage of International Application No. PCT/EP2011/073638, filed on Dec. 21, 2011, which claims priority to European Patent Application No. 10196359.3, filed Dec. 21, 2010, the entire contents of which are being incorporated herein by reference.

FIELD OF THE INVENTION

The present invention relates to a container and a pouch. The container and pouch are preferably mutually shaped so that the pouch fits tightly into the container. The container comprises a closure for closing the container and preferably is adapted to maintain the pouch in an open state in a position where its opening is facing upwardly. In addition, the closure comprises a lid, allowing re-closable access to the contents stored in the pouch.

BACKGROUND OF THE INVENTION

A common pouch in a container kit comprises fitting a pouch in a container. To gain access to the content stored in the pouch, one needs to open the container and then open the pouch. The pouch may be closed by a plastic clip. Closing is done in the reverse manner. Drawbacks of such a pouch in a container kits are numerous and some of them are: unconvenient for consumers, especially if used frequently, because pouch and container are not fitted together; the opening and closing process is time and effort consuming; pouring content from the pouch in container kit is difficult if not impossible; contents stored often spills outside the kit; hygiene and contamination is often a concern; the pouch is often smaller than the internal volume of the container, which results in lost storing capacity; it may be difficult to serve content from the pouch when little content is left.

U.S. Pat. No. 5,165,568 relates to an automatically resealing container consisting of an interior paperboard box and an external resealing bag of flexible plastic film. The film is associated with closure flaps of the box such that when the flaps are reclosed, the film is pressed together outside the box to provide a nearly airtight seal. The single external film bag provides the dual function of protecting the contents as well as the exterior of the box. This device may require a two-step closing as the flaps may have to be guided into a slit during closing. Thus, the closing procedure proves to be delicate and to require vigilance of the user.

US 2008/0179357 relates to a package designed to facilitate the use of squeeze bottle or other dispensers for wet products such as mayonnaise. The package consists of an external semi-rigid bottle or container, a bottle pouch placed inside the external container and food product. The bottle pouch has a peelable primary seal area and a secondary membrane with lines of weakness for ready opening of the pouch when the pouch flaps are pulled over the side of the bottle or during dispensing. Dispensing of the contained product happens by applying pressure on the external bottle.

As can be understood from this document, this device is designed to contain wet products, but cannot be hermetically reclosed after peeling of the pouch. The device remains constantly opened, therefore the product remains in prolonged contact with air which may lead to hygiene issues.

Hence, an improved pouch in a container kit would be advantageous.

OBJECT OF THE INVENTION

It is a further object of the present invention to provide an alternative to the prior art and in particular to provide a pouch in container kit providing safe storage of and easy access to substances in the pouch.

SUMMARY OF THE INVENTION

Thus, the above described object and several other objects are intended to be obtained in a first aspect of the invention by providing a pouch in a container kit comprising a pouch and a container adapted to receive the pouch. The container comprises a body part having one or more side walls and a bottom forming an open ended container, wherein the one or more sides walls defines an opening positioned opposite to the bottom. The container further comprises a closure with a lid. The pouch comprises a top having flaps. The pouch may be inserted through the opening into the body part of the container. During use of the kit, the flaps are folded around distal end(s) of the one or more side walls and the closure is adapted to accommodate the distal end(s) of the one or more side walls with the flaps folded around to provide a closure of the container with the pouch arranged internally.

The invention is particularly, but not exclusively, advantageous for obtaining the effect of the container storing the pouch in a manner where easy access to the content of the pouch may be obtained without opening of closing of the pouch, as access to the content in the pouch is gained by the lid. In addition, the pouch may be maintained in the container due to the folding of flaps over the distal ends of the walls. Furthermore, by having the pouch maintained in the container with flaps folded around distal end(s), one may easily pour as well as scoop the content out.

The pouch in a container kit is convenient, easy and faster to open and re-close, pouring is easy, without or with reduced product spilling outside the container, more hygienic, pouch and container sizes are well optimised, dispensing is easy even with small quantities of product left in the pouch. The pouch itself can be designed in different manners depending on actual needs or preferences. Corner cuts, hole, sealing profile and pouch can be given different designs.

The kit may be used in several manners. Typically, a consumer may purchase a pre-filled pouch and a container in an initial buy. The pouch may be arranged in the container or delivered separate from the container. Later, the consumer will preferably only purchase the pouch and re-use the container. Although an advantageous effect of the invention is that the consumer may be provided with pre-filled pouches, the invention may also be utilised in a manner where e.g. the consumer purchase an empty pouch and fills the pouch with the desired substance themselves, or from a bulk container at the grocery for instance.

According to preferred embodiments of the pouch in a container kit the pouch may comprise four side walls thereby defining a box shape and the top may be folded into a gusset form by folding along folding lines. The folding line may preferably comprise:

- horizontal folding lines encircling the pouch (ie: a peripheral folding line around the pouch),
- first vertical folding lines along the edges of the side walls
- a pair of oblique folding lines on two opposite side walls extending from intersections between a horizontal folding line and a vertical folding line to an intersection between the oblique folding lines, and second vertical folding lines extending from the intersection between the oblique folding lines and upwardly to an upper edge of the side walls in question.

In addition, the flaps are preferably tapered having their largest width at the onset of the flaps. However, the flaps may alternatively be rectangular.

In an embodiment, embodiments, the pouch may comprise four side walls thereby defining a box shape and the top having two flaps only.

In an embodiment, the comprises at least a reinforcement tongue which is formed by two curvilinear cuts each extending between the edge of the side walls and the flap folding lines respectively.

In an embodiment, the pouch may be closed by sealing the flaps together. Preferably the sealing is provided by a heat sealing, a gluing or the like.

In container kits according to the present invention, the container may comprise retaining means for retaining the closure in its position where it closes the container.

The closure may comprise a frame to which the lid is rotatably connected, the lid further comprises a lock in the form of a flap that extends down to and snaps on to a rim of the closure.

In many advantageous embodiments of the invention, the pouch may be made more flexible that the container.

The kit may preferably comprise securing means for fixing tightly the pouch relatively to container. Such securing means may ease the assembly of the kit as the securing means provides a fixation of the pouch inter alia while the closure is not applied to the container. The securing means may preferably comprise: a knob on the container and a corresponding opening in a flap, Velcro arranged on the container and on a flap, glue such as reversible glue provided on the container and/or on a flap.

In a second aspect the invention relates to a container comprising a body part having one or more side walls and a bottom forming an open ended container. The one or more side walls define an opening positioned opposite to the bottom and through which a pouch may be inserted into the body part. The container further comprises a closure with a lid and the closure being adapted to accommodate the distal end(s) of the one or more side walls with flaps formed in an opening of the pouch being folded around the distal end(s) to provide a closure of the container with the pouch arranged internally.

In a third aspect the invention relates to a pouch comprising a top having flaps. At least the top of the pouch is foldable so as to close the pouch and the flaps are adapted to be folded around distal ends of side walls of a container while the distal ends of the side walls are accommodated by a closure of the container into which the pouch is arranged.

It is noted, that features presented in relation to the various aspect are compatible and may be combined among the various aspects of the invention.

In addition, the flaps may preferably be provided in different ways. For instance, the flaps may advantageously be provided during manufacturing of the pouch. Alternatively, the flaps may be provided during use of the pouch—e.g. by the consumer cutting corners, breaking perforations or the like upon or prior to insertion of the pouch in the container.

The various aspects are particular useful for reducing the amount of waste material as the container may be re-used and the pouch being the replaceable part may be optimized so as to avoid production of superfluous waste material.

The instant container and pouch may be used in several areas. Non-limiting examples are storing and dispensing of dry consumable products. Dry consumable products include for instance all types of powdered or particulate products such as infant formula, infant cereals, soluble coffee, soluble coffee mixes, soluble tea, soluble chocolate powder for beverages, and other powdered beverages; grocery products such as flour, oat flakes, breakfast cereals, sugar, rice, pasta, ground coffee, tea leaves; flaky products such as seasoning, or culinary powder.

BRIEF DESCRIPTION OF THE FIGURES

The invention and in particular different embodiments thereof will now be described in more detail with regard to the accompanying figures. The figures show manners of implementing the present invention and are not to be construed as being limiting to other possible embodiments falling within the scope of the attached claim set.

FIG. 2 is a three dimensional view showing schematically initial steps for preparing the pouch in a container kit of FIG. 1 for use.

FIG. 5 is a three dimensional view showing a pouch according to the present invention in an open state, together with an.

DETAILED DESCRIPTION OF AN EMBODIMENT

Figure 1:
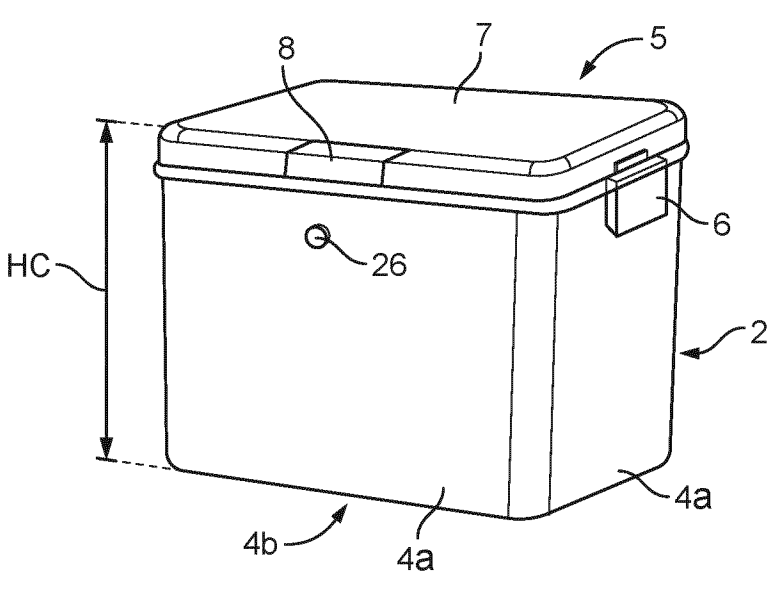
FIG. 1 is a three dimensional view showing separately a pouch and a container for a preferred embodiment of a pouch in a container kit according to the present invention.
Figure 1:
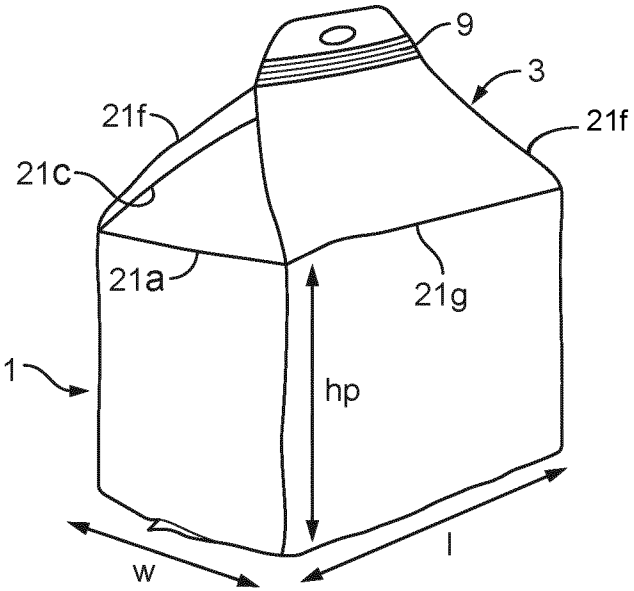

Referring to FIG. 1, an embodiment of the invention is disclosed, which comprises a pouch 1 and a container 2. As indicated on FIG. 1, the pouch 1 is box-shaped with a flat rectangular bottom with side lengths I and w. The top 3 of the pouch is gusset-shaped and the distance from the bottom of the pouch 1 to the gusset-shaped top is hp.

As indicated in FIG. 1 the container 2 match the size of the pouch 1, that is the internal dimensions of the container are selected so as to be sufficiently close to I, w to provide a firm fit of the pouch 1 inside the container 2 while still allowing an easy insertion of the pouch 1 in the container 2. The height hp of the pouch 1 may be similar to or smaller than the height hc of the container 2 depending on the implementation of the gusset form of the top 3. This will be disclosed in greater details with reference to FIG. 5.

Figure 5:
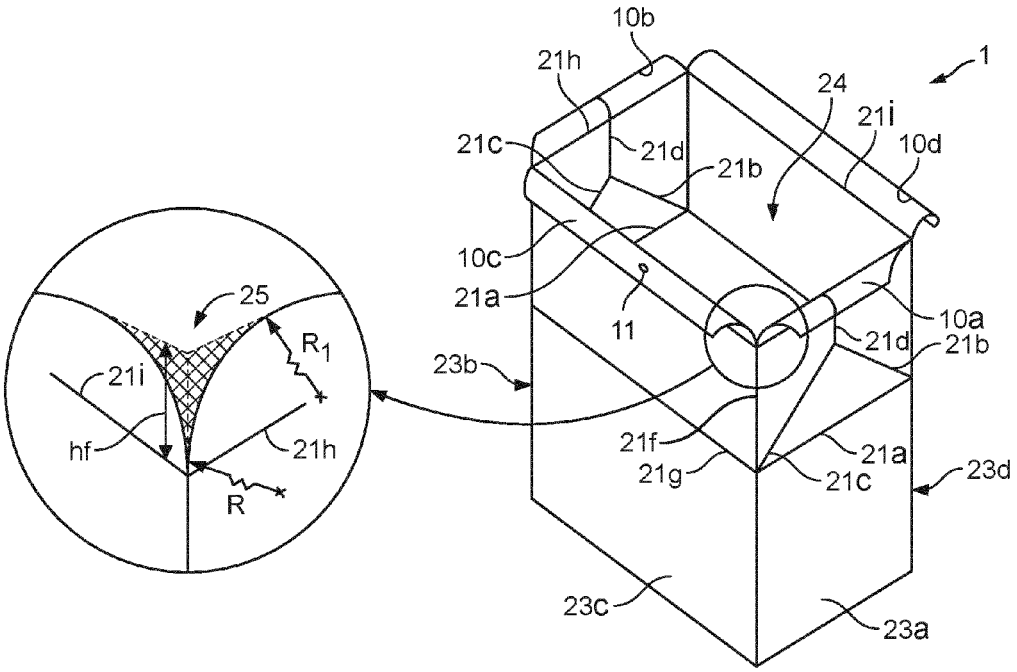

The gusset shape of the top 3 is formed by folding the open end (20, in FIG. 5) of the pouch 1 so as to close the pouch 1. The part of the pouch 1 being folded ranges from folding lines 21*a* and 21*g* and upwardly. As shown in FIG. 5, the top 3 has flaps 10*a-d* which will be disclosed in further details below. Typically, the upper parts of two opposite sides are folded inwardly along folding lines (21*a-f* in FIG. 5) provided as indentations where after the remaining upper parts of the two remaining sides are folded inwardly to form the gusset. Suitable sealing—shown with numeral 9 in FIG. 1—in the form of glue or heat welding is provided at the top of the gusset 3 to provide a sealed closing of the pouch 1.

As the flaps 10*a-d* is to be folded around the distal ends of the side walls 4*a* of the container, the sealing 9 should be selected so that the pouch 1 may be pealed opened without destroying the flaps 10*a-d* nor the pouch 1.

The container 2 comprises a body part 4 having four sides walls 4*a* and a bottom 4*b* forming an open container. The sides walls 4*a* defines an opening 24, positioned opposite to the bottom 4*b*, through which the pouch may be inserted into the body part 4.

The container 2 further comprising a closure 5 detachable arranged to close the opening of the container 2. When the pouch is located in the container, the flaps are folded around the distal (relatively to the bottom 4*b*) ends of the side walls 4*a* as shown in e.g. FIGS. 3 and 4. Closing of the container 2 is provided by the closure 5 being adapted to accommodate the distal ends of the side walls 4*a* with the flaps 10*a-d* being folded around. This accommodation is provided by the skirt portion 13 of the closure 5. By providing a firm fit between the closure 5, the flaps 10*a-d* and the distal end(s) of the side wall 4*a*, fixation of the pouch 1 relatively to the container 2 is possible. Once the pouch 1 is situated in the container 2, the flaps 10*a-d* folded and the closure 5 applied, the pouch in a container kit is ready for use.

The closure 5 is retained in its closing position by use of two locks 6 which are hingedly arranged on the closure 5 and clicks onto an edge of the container 2. In addition, the container comprises a knob 26 on the front side of the container 2 and an equally arranged knob 26 on the opposite side of the container, the purpose of which is disclosed below.

The closure 5 comprises a rectangular shaped lid 7. The lid 7 can rotate about an edge of the lid 7 relatively to the remaining parts of the closure 5. The lid 7 further comprises a lock 8 in the form of a flap that extends down to and snaps on to a rim of the closure 5. The lid 7 is preferably an integral part of the closure 5. Thus, the closure as presented in FIG. 1 comprises a frame to which the lid is rotatably connected, the frame is the part of the closure that maintains its position relatively to the container 2 during use.

The pouch 1 is preferably made from a plastic material and the thickness of the plastic material is chosen so as to allow sufficient flexibility to allow insertion of the pouch 1 into the container 2, which may require some squeezing while still allowing sufficient strength to avoid breakage during e.g. transportation. The container 2 is also preferably made from a plastic material and the thickness of the plastic material for the container 2 is chosen so that the container is more rigid than the pouch 1. By selecting the thickness of the materials in this manner, a pouch in a container kit is obtained in which the relatively more vulnerably pouch is protected by the container 2 from being punctured or ruptured.

The pouch 1 shown in FIG. 1 is shown in a closed state and prior to use. The upper corners 25 (see e.g. FIG. 5) of the closing area, that is the area composed by the flaps (10*a-d*), have been removed thus providing four flaps upon opening of the pouch 1. This will be disclosed in further details below.

Use of the pouch in a container kit will now be described with reference to FIGS. 2-4.

FIG. 2 shows removal of the closure 5 from the container. The locks 6 are released and the closure is removed from the container 2 as indicated by the arrow shown on top of the lid 7. The pouch 2 is pealed open by breaking the seal 9. It is noted that although the peal open procedure is shown in a situation where pouch 1 is not in the container 2, the procedure may be carried out while the pouch 1 is situated inside the container 2 with no closure 5 applied.

Figure 3:
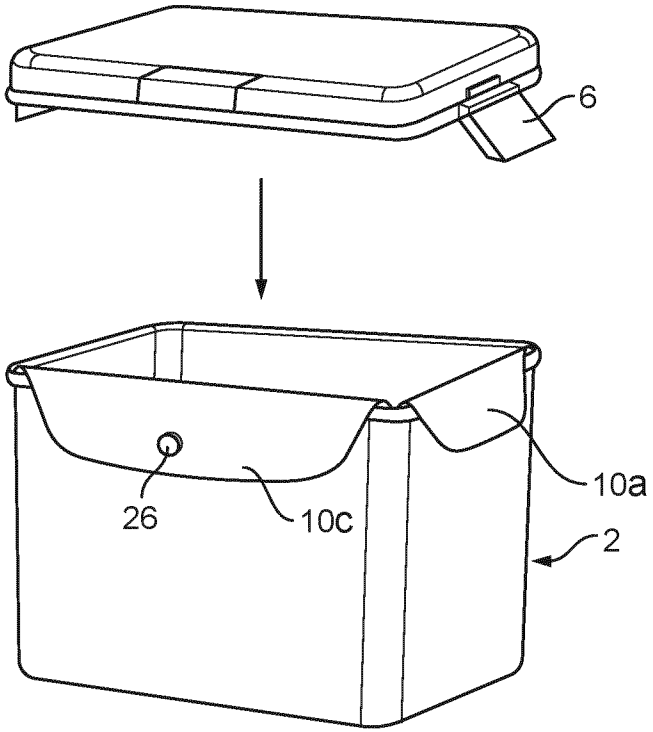
FIG. 3 is a three dimensional view showing schematically steps for preparing the pouch in a container kit of FIG. 1 for use, the step being subsequent to the step shown in FIG. 2.
Figure 3:
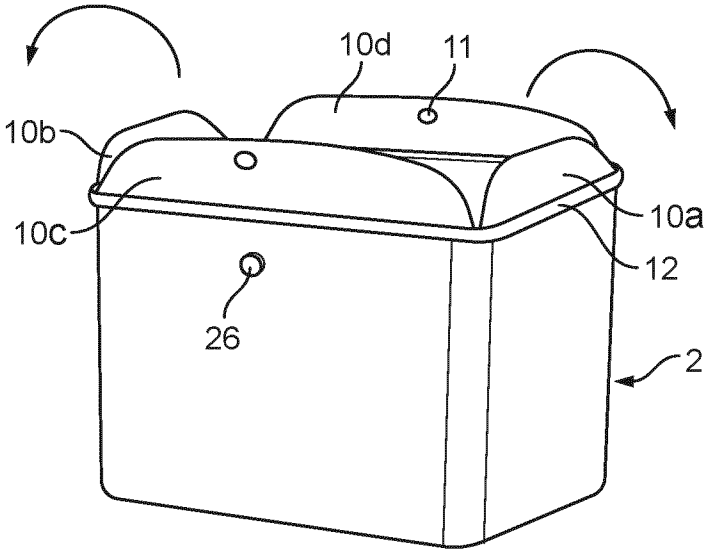

FIG. 3 shows how to make the pouch in a container kit ready for use once the pouch 1 has been located in the container 2.

With reference to the drawing shown to the left in FIG. 3, the top 3 is opened. This opening is provided by breaking the seal 9, thereby releasing the four flaps 10*a-d*. These four flaps 10*a-d* are each folded around the edge of the opening of the container 2 until they extend along the sides 4*a* of the container as shown to the right in FIG. 3. The openings 11 provided in the two flaps 10*c* and 10*d* are each squeezed over the knobs 26 to attach the flaps to the sides of the container 2. The knob 26 on the container and a corresponding opening 11 in a flap constitutes securing means, that will assist in keeping the pouch positioned in the container at least during application of the closure 5. This may be particular useful if a pouch 1 is used that has a smaller height hp than the height of the container hc. The opening 11, may be provided as a hole or as a puncture e.g. a cross shaped puncture, that allows the knob to be pressed through the opening 11. Alternatively, the securing means may be provided by glue, preferably being reversible glue or Velcro provided on the wall of the container and the flaps (in case of glue it may be sufficient to provide glue to only the container wall or the flap).

Having the flaps attached to the container 2 and further maintained by the closure 5 allows keeping the pouch opened permanently, therefore avoiding time and effort consuming process of opening and closing the pouch each time one wants to consume the dry consumable products contained in the pouch. Hygienic issues and contamination are avoided due to the lid 7. This will be disclosed in greater details with reference to the FIG. 4.

Once the flaps are folded and attached to the sides of the container 2, the closure is brought into its position to close the container as indicated by the arrow shown to the right in FIG. 3. Finally, the locks 6 are engaged and the pouch in a container kit is ready for use.

The closure 5, the pouch 1 and the body part 4 of the container are preferably mutually adapted to provide a sealed pouch in a container kit. Various degrees of sealing are provided spanning from powder tight to prevent powdered material from escaping the container to fluid tight preventing fluids from being spilled from the container. The sealing to be obtained (in case a sealed kit is aimed at) is a sealing of the lid 7, and a sealing between the container 2 and the closure 5.

The sealing of the lid is obtained by providing a recess in the closure 5 adapted to receive an edge provided along the rim of the lid 7. Such a kit will at least provide a powder tight seal. If a fluid tight seal is desired a gasket may be arranged in the recess. Sealing between the closure 5 and the body part 4 is provided by the flaps 10*a-d* folded around an edge 12 provided at the upper end of the body part and mating with a corresponding recess provided in the skirt portion 13. Thereby a sealing being at least powder tight is provided when the closure 5 is provided to the body part 4 of the container. If a fluid tight seal is aimed at this may be provided by selecting the material of the pouch as—or coat the part of the pouch contacting the edge 12 and the recess of the closure with a suitable sealing material e.g. rubber.

Figure 4:
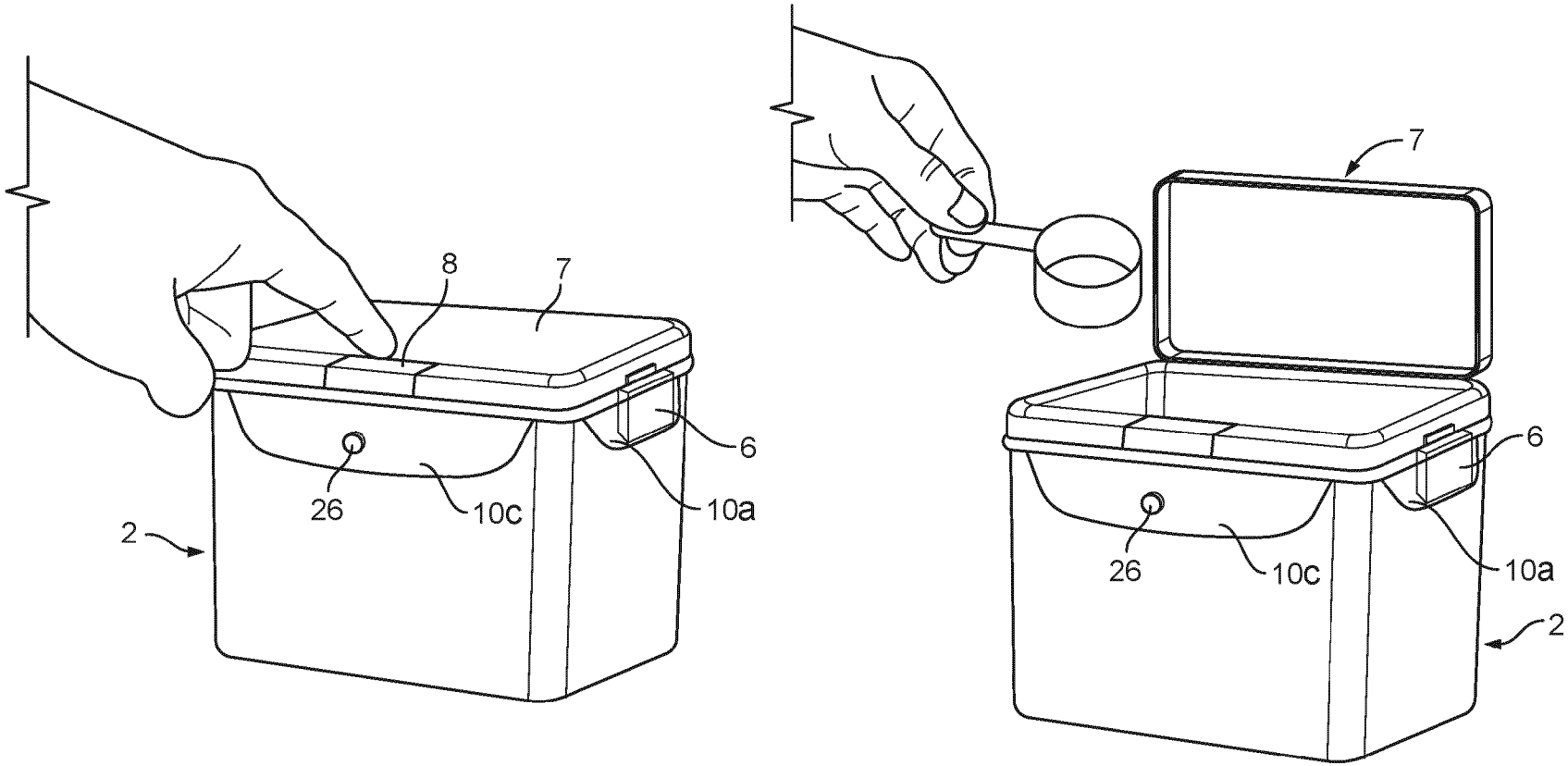
FIG. 4 is a three dimensional view showing schematically pouch in a container kit shown in FIG. 1 during use.

Use the pouch in a container kit is shown in FIG. 4. Initially, the lock 8 is dis-engaged followed by rotation of the lid 7 into a position where access to the content stored in the pouch is available; cf. the right drawing in FIG. 4. Once the lid is opened, the content may be dispensed e.g. by use of a spoon as shown in the right drawing of FIG. 4 or the container 2 may be tilted whereby the content may be poured from container 2. Thereby, the product is easily accessible for the consumer, even when little content is left.

FIG. 5 is a three dimensional view showing a pouch according to the present invention in an open state with outwardly folded flaps 10*a-d*. The pouch 1 is box shaped and comprising four side walls 23*a-d*. The pouch 1 also comprises a bottom (not shown) that is provided by folding and gluing or welding parts of the side walls 23*a-d* to form a sealed bottom in a manner well known to a skilled person. Numeral 24 indicates powdered material arranged in the pouch 1.

As indicated in the figure, the pouch 1 is provided with folding lines 21*a-f* provided as indentations in the pouch 2. The folding lines comprises:

- horizontal folding lines (21*a*, 21*g*) encircling the pouch (1)
- first vertical folding lines (21*e*, 21*f*) along the edges of the side walls (4*a*)
- a pair of oblique folding lines (21*c*, 21*b*) on two opposite side walls (4*a*) extending from intersections between a horizontal folding line and a vertical folding line to an intersection between the oblique folding lines, and
- second vertical folding lines (21*d*) extending from the intersection between the oblique folding lines (21*c*, 21*b*) and upwardly to an upper edge of the side walls (4*a*).

The top 3 is thereby provided with the gusseted shape by folding along the folding lines 21*a-f* in the following manner:

- each side 23*a* and 23*b* are simultaneously folded inwardly along the folding lines 21*a-f*; during this folding the flaps 10*a-d* are not outwardly folded.
- as the folding along the folding lines 21*a-f* takes place, a folding along a further folding line 21*g* (that may be omitted) on each of the remaining sides gradually takes place.
- at the end of the folding process, the flaps 10*a-d* are abutting each other and e.g. a heat sealing or gluing may be applied to provide the sealing 9.

The result of the folding is that the folding lines 21*a*, 21*f* and 21*g* (if present) becomes outer edges of the pouch 2 and the folding lines 21*b* and 21*c* becomes internal corners as shown in FIG. 1 left drawing.

As shown in FIG. 5, the flaps 10*a-d* are provided by removal of the upper corners 25 of the folded sealed pouch 1. Thereby, flaps 10 are tapered having their largest width at the onset of the flap, that is at folding lines 21*i,h*.

The removal of the upper corners 25 is provided by two oblique cuts each extending from the edge formed between two side walls 23*a-d* to an upper edge of the side wall in question 23*a-d*. This is shown as a magnified view in FIG. 5 where the cross-hatched areas indicate material being cut-away (the magnified view of FIG. 5 shows the contrary to the full FIG. 5 the flaps in a non-folded state). It is noted, that the removal of the corners may also be done after the top 3 has been folded although the removal of the corners preferably is done during manufacturing of the pouch 1. It is also noted that the size and the shape of the flaps 10*a-d* is determined by the cut and e.g. the height of the flap is determined by the depth of the cut hf shown in FIG. 5. Typically, the cut is rounded off to avoid sharp corners (indicated by R in FIG. 5).

The flaps can be implemented in different ways. For instance, the corners 25 to be removed may be provided by perforations allowing the corners 25 to be removed when desired, including also after folding. In addition, the flaps may be provided by cutting—or providing perforations—along folding lines 21*e,f* whereby no corners are removed. A further way of providing flaps includes providing graphical indications as to where to cut to remove the corners 25. Thereby the provision of the flaps may be provided by the user.

The upper corners 25 are as said above preferably removed during manufacturing of the pouch 1. According to a preferred way of manufacturing the pouch 1, the pouch is made from an unfolded and flat piece of flexible material e.g. plastic, aluminium, cardboard, paper or the like. Folding lines and corner cuts are provided to the piece of plastic where after, the piece of plastic is folded into the box shape shown in FIG. 5 (the flaps are still not folded) in a conventional manner. The pouch 1 is filled with the desired content and the top part is folded into the gusset shape and sealed. Thereafter the pouch is ready for use.

Flap folding lines 21*i* and 21*h* assisting in folding the flaps 10*a-d* around the distal ends of the side walls 4*a* may be provided at the onset of the flaps 10*a-d*.

Alternatively, the corner cuts may be provided after the top is folded into its gusset form by cutting away the two top corners of the pouch 1.

The opening 11 is punched into the top 3 of the pouch 1. The corner cuts and opening 11 are made above the above the seal area 9. This is to preserve the tightness of the pouch 1.

By cutting the corners, one eliminates the excess material and when the pouch 9 is open it creates four flaps. These flaps can be easily folded over the rims of the container 1 once the pouch is inside the container 2. The small opening 11 in the longer flaps can be used to attach the flaps on the exterior of the container by use of the knob 26. The closure 5 with to lock 6 on the smaller sides retain the closure 5 on the container 2. By clipping the closure 5, a tightly closed container is obtained with a well-fixed pouch inside. Various openings can be designed on the interior of the lid to allow pouring, scooping, etc.

Figure 8C:
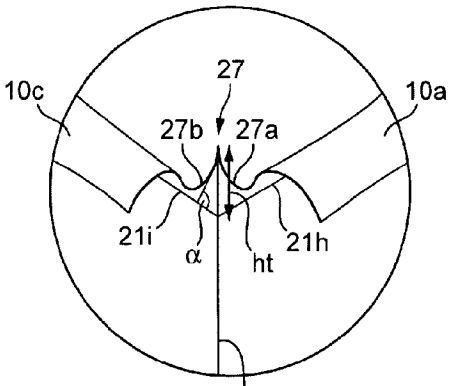
FIG. 8C is a magnified view of the corner of the pouch of FIG. 8A, in the open state, showing a reinforcement tongue.
Figure 8B:
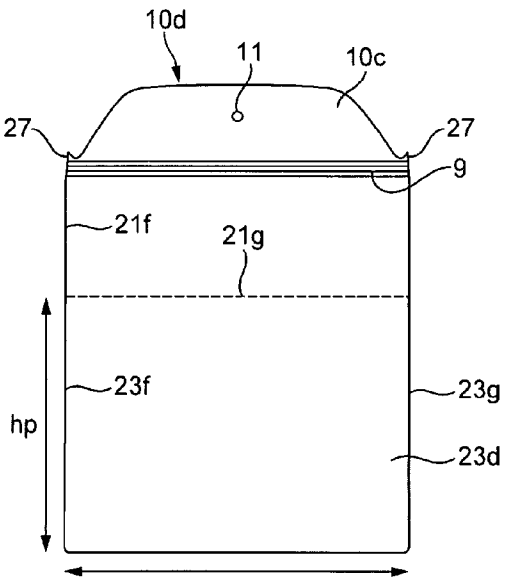
FIG. 8B is a front view of the pouch depicted at FIG. 8A.
Figure 8A:
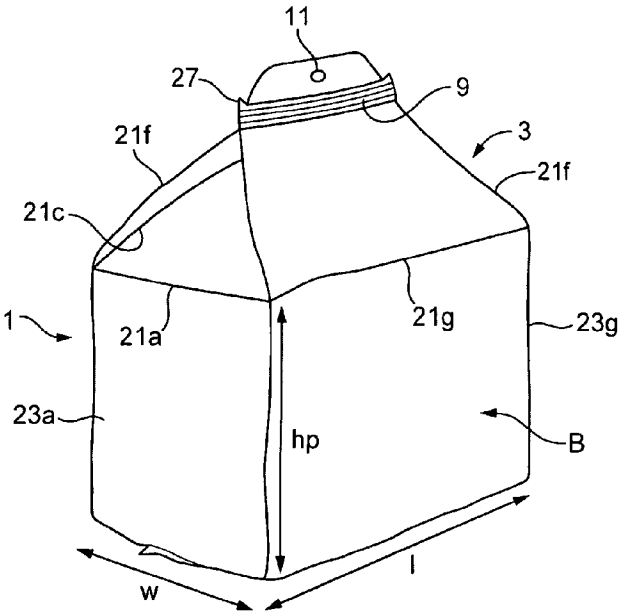
FIG. 8A is a perspective view showing another embodiment of a pouch according to the present invention, when closed.

Referring now to FIGS. 8A, 8B and 8C, a tongue 27 can be provided for during the formation of the flaps in order to prevent tearing the pouch when opening. Tongue 27 is shaped along the edge of the side walls 23*a-d* during the removal of the upper corners 25. This is shown as a magnified view in FIG. 8. The tongue 27 is formed by two curvilinear cuts 27*a*, 27*b* each extending between the edge 21*f* of the side walls 23*a*, 23*c* and the flap folding lines 21*i*, 21*h* respectively. The cut 27*b* is made according to an angle alpha $\alpha$ defined between the folding line 21*i* and the tangent to the curvilinear cut 27*b* that goes through the extremity of the tongue 27. Preferably, the angle $\alpha$ is an integer comprised between 10° and 45°, most preferably 30°. Preferably, the curvilinear cut 27*b* has a radius of curvature comprised between 4 and 10 mm, and most preferably 6 mm. The cut 27*a* is symmetrical to cut 27*b*, in order to provide tongue 27, and each corner of the pouch can be provided with a similar tongue, as shown on FIG. 8A.

The tongue 27 reinforces the corners of the pouch and prevents a weakness point at the flap onset. This helps preventing the pouch from tearing along the edges 23*e-h* of the side walls 23*a-d* when opening of the pouch.

As shown on FIG. 8B, the cuts 27 can be made in a single step, using the appropriately shaped knife, on the folded and sealed pouch. In other words, once the pouch 1 is formed and its bottom is sealed, the pouch is filled with the food product. Then the open ended top 3 of the pouch is folded, then sealed. And finally, the flaps 10*a-d* and the tongues 27 are formed by cutting off the material 25, above the seal 9.

The above disclosure of the pouch in container kit has focussed on a kit where the pouch 1 comprises four flaps (10*a-d*) each being folded or foldable around a corresponding distal end of a side wall of the container 2. However, the invention is not limited to kits with four flaps and/or a top being folded into a gusset shape. In another embodiment shown in FIG. 6, the top 3 only comprises two flaps 10*a* and 10*b* which are foldable to close the top of the pouch 1.

Figure 6:
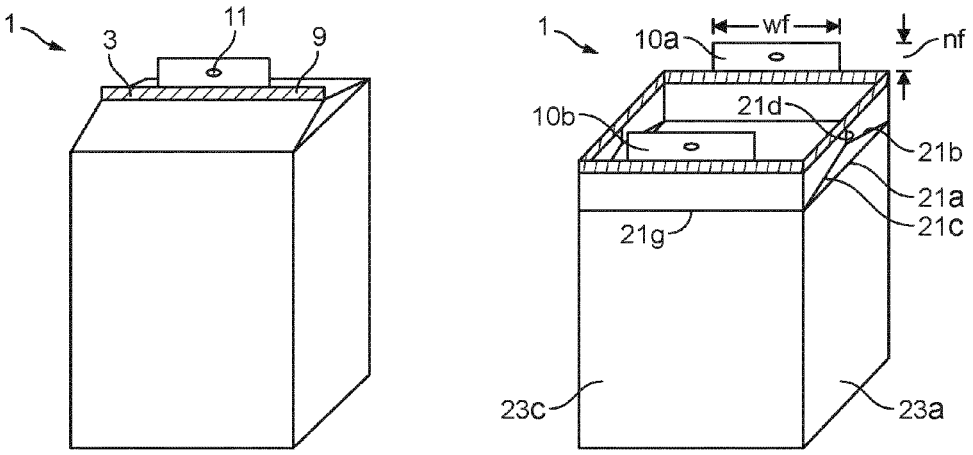
FIG. 6 is a three dimensional view showing a further pouch according to the present invention with two flaps only, the pouch is shown in close state to the left, and in open state to the right.

FIG. 6 is a three dimensional view showing a further pouch according to the present invention with two flaps only, the pouch is shown in close state to the left, and in open state to the right. As shown in FIG. 6 (right figure) the pouch 1 is similarly to the pouch disclosed in relation to FIG. 5 box shaped with a closed bottom. Reference numerals introduced in the preceding figures are used for identical or similar structural elements in FIG. 6. The pouch 1 of FIG. 6 has folding lines 21*a-g* assisting in providing the desired folding. The folding of the pouch 1 is as disclosed in relation to FIG. 5 and sealing is providing by gluing or heat sealing 9 at the top 3. As indicated in FIG. 6, only two flaps 10*a* and 10*b* are provided, and these flaps are provided at the longer sides opposite to each other of the pouch 1. The flaps may alternatively be provided at the shorter sides of the pouch 1. The width of the flaps WF 10*a,b* may be selected as indicated in FIG. 6 to be shorter than the width of the side WS. The height of the flaps 10*a,b* HF is selected so as to provide a sufficient folding around the distal ends of the container 2 (similarly as for the other embodiments disclosed herein).

Figure 7:
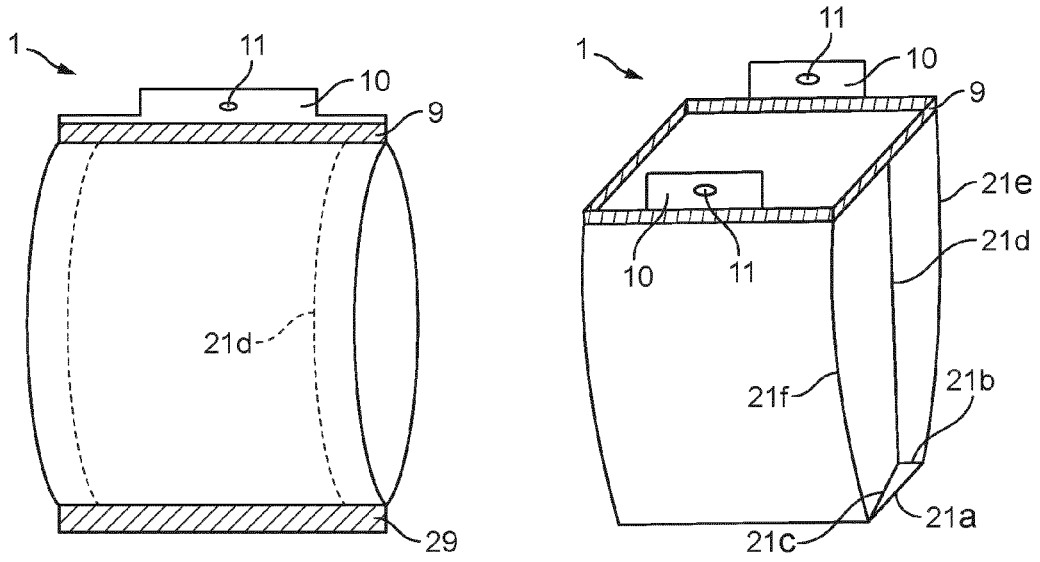
FIG. 7 is a three dimensional view showing yet a further pouch according to the present invention with two flaps only, the pouch is shown in close state to the left, and in open state to the rights.

FIG. 7 is a three dimensional view showing yet a further pouch according to the present invention with two flaps only, the pouch is shown in close state to the left, and in open state to the rights. Reference numerals introduced in the preceding figures are used for identical or similar structural elements in FIG. 7, although for instance the folding of the sides of the pouch 1 is done a different manner than what is disclosed in relation to FIG. 5 e.g.

The pouch 1 of FIG. 7 may have folding lines 21*a-f* assisting in providing the desired folding. The folding of the pouch 1 is then as disclosed in relation to FIG. 5 except that the folding due to the location of the folding lines 21*a-c* are located at the bottom of the pouch 1 whereby the pouch 1 by folding along folding lines 21*a-f* as in FIG. 5 provides a pouch 1 with the shape indicated in FIG. 7 left side. Please note, that the pouch 1 of FIG. 7 left has a bottom shape that has been provided by e.g. heat sealing or gluing 29 and that if the sealing or gluing is not provided, the bottom shape will be gusset shaped.

Sealing of the pouch 1 of FIG. 7 is providing by gluing or heat sealing 9 at the top 3. As indicated in FIG. 7, only two flaps 10*a* and 10*b* are provided, and these flaps are provided at the longer sides opposite to each other of the pouch 1. The flaps may alternatively be provided at the shorter sides of the pouch 1 as disclosed in relation to FIG. 6

Thus, although the above disclosure has focussed on a pouch in container kit wherein the container and pouch having four side walls, the container 2 and/or the pouch may be provided with another number of walls, e.g. the pouch may be tubular shaped (to preferably accommodate a pouch as disclosed in FIG. 8) with only one side wall, shaped with three side walls etc. Similarly, the container may be tubular shaped etc.

As indicated above, the material for the container 2 and the pouch 1 may advantageously be selected so that the container 2 may prevent the pouch 1 from being punctured or ruptured. Although this is not a specific requirement, it has been found in relation to the present invention that suitable non-limiting examples for the material of the pouch 1 are: plastic, aluminium, paper, cardboard or the like and combinations thereof; and that suitable non-limiting examples for the material of the container are: plastic, aluminium, paper, cardboard, glass or the like and combinations thereof. In a specific preferred embodiment of the pouch in a container kit, the container is made from plastic and the pouch is made from aluminium.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed:

1. A kit comprising:

a pouch; and a container adapted to receive the pouch, the container comprising a body part having one or more side walls and a bottom forming an open ended container, the one or more side walls defining an opening positioned opposite to the bottom, and a closure with a lid, the pouch is suitable for containing a dry consumable product, comprises a top having flaps hermetically sealed together, and at least one reinforcement tongue, the reinforcement tongue formed by two curvilinear cuts each extending between an edge of the side walls and flap folding lines, respectively, and the pouch is suitable for being inserted into the body part of the container; and during use of the kit, the flaps are folded around a distal end of the one or more side walls and the closure is adapted to accommodate the distal end of the one or more side walls with the flaps folded around to provide a closure of the container with the pouch arranged internally.

2. A pouch in a container kit according to claim 1, wherein the flaps are tapered having their largest width at the onset of the flaps.

3. A pouch in a container kit according to claim 1, wherein the pouch comprises four side walls thereby defining a box shape and the top having only two flaps.

4. A pouch in a container kit according to claim 1, wherein the pouch is closed by sealing the flaps together.

5. A pouch in a container kit according to claim 1, wherein the container comprises a retainer for retaining the closure in its position where it closes the container.

6. A pouch in a container kit according to claim 1, wherein the closure comprises a frame to which the lid is rotatably connected, the lid comprises a lock in the form of a flap that extends down to and snaps on to a rim of the closure.

7. A pouch in a container kit according to claim 1, wherein the pouch is more flexible that the container.

8. A pouch in a container kit according to claim 1, wherein the kit comprises a securing member for fixing tightly the pouch relatively to container.

9. A pouch in a container kit according to claim 1, wherein the pouch comprises four side walls thereby defining a box shape and the top of the pouch is folded into a gusset form by folding along folding lines comprising:

horizontal folding lines encircling the pouch, first vertical folding lines along the edges of the side walls, a pair of oblique folding lines on two opposite side walls extending from intersections between a horizontal folding line and a vertical folding line to an intersection between the oblique folding lines, and second vertical folding lines extending from the intersection between the oblique folding lines and upwardly to an upper edge of the side walls in question.

* * * * *